US010702437B2

(12) United States Patent
Clark et al.

(10) Patent No.: US 10,702,437 B2
(45) **Date of Patent: *Jul. 7, 2020**

(54) SURGICAL SUPPORT SYSTEM

(71) Applicant: Allen Medical Systems, Inc., Batesville, IN (US)

(72) Inventors: Andrew D. Clark, Allston, MA (US); Anthony V. Catacchio, Arlington, MA (US); Jesse S. Drake, Westborough, MA (US); Dustin T. Libby, Naples, FL (US)

(73) Assignee: Allen Medical Systems, Inc., Batesville, IN (US)

( * ) Notice: Subject to any disclaimer, the term of this patent is extended or adjusted under 35 U.S.C. 154(b) by 464 days.

This patent is subject to a terminal disclaimer.

(21) Appl. No.: 15/659,712

(22) Filed: Jul. 26, 2017

(65) Prior Publication Data

US 2017/0319415 A1 Nov. 9, 2017

Related U.S. Application Data

(63) Continuation of application No. 13/799,251, filed on Mar. 13, 2013, now Pat. No. 9,730,851.

(60) Provisional application No. 61/698,547, filed on Sep. 7, 2012.

(51) Int. Cl.

| | |
|---|---|
| ***A61G 13/12*** | (2006.01) |
| ***A61G 13/10*** | (2006.01) |
| ***A61G 13/00*** | (2006.01) |

(52) U.S. Cl.

CPC ..... *A61G 13/1205* (2013.01); *A61G 13/00* (2013.01); *A61G 13/101* (2013.01); *A61G 13/1245* (2013.01); *A61G 2205/20* (2013.01)

(58) Field of Classification Search

CPC ..... A61G 7/075; A61G 7/0755; A61G 13/00; A61G 13/101; A61G 13/1205; A61G 13/1245; A61G 13/125; A61G 2205/20

See application file for complete search history.

(56) References Cited

U.S. PATENT DOCUMENTS

| | | | |
|---|---|---|---|
| 1,160,451 | A | 11/1915 | Sanford |
| 1,501,120 | A | 7/1924 | Karrer |
| 3,509,876 | A | 5/1970 | Pilz |
| 3,654,920 | A | 4/1972 | Staib |
| 3,745,996 | A | 7/1973 | Rush, Sr. |
| 3,982,742 | A | 9/1976 | Ford |
| 4,180,062 | A | 12/1979 | Alberti et al. |

(Continued)

FOREIGN PATENT DOCUMENTS

| | | |
|---|---|---|
| DE | 102008057336 | 6/2010 |

OTHER PUBLICATIONS

European Search Report for EP Application 13183197.6; Place of search—The Hague; Date of completion of the search—Dec. 6, 2013.

(Continued)

*Primary Examiner* — Robert G Santos

(74) *Attorney, Agent, or Firm* — Barnes & Thornburg LLP

(57) ABSTRACT

A surgical table extension comprises a frame and a connector. The frame includes a surgical table connecting portion, a first connector, and a second connector. A connector enabler is movably coupled to the frame and is configured to selectively enable one of the first connector and the second connector to be removably coupled with a support device.

11 Claims, 15 Drawing Sheets

(56) References Cited

U.S. PATENT DOCUMENTS 4,180,254 A 12/1979 Lee et al.
4,185,813 A 1/1980 Spann
4,252,306 A 2/1981 Johnson et al.
4,367,869 A 1/1983 Dailey et al.
4,373,709 A 2/1983 Whitt
4,407,277 A 10/1983 Ellison
4,418,900 A 12/1983 Ricke
4,428,571 A 1/1984 Sugarman
4,443,005 A 4/1984 Sugarman et al.
4,471,952 A 9/1984 Spann
4,482,138 A 11/1984 Spann
4,526,355 A 7/1985 Moore et al.
4,545,573 A 10/1985 Murphy
4,579,324 A 4/1986 McConnell
4,620,698 A 11/1986 Reed et al.
4,681,309 A 7/1987 Lechner
4,702,465 A 10/1987 McConnell
4,732,145 A 3/1988 Latham
4,766,892 A 8/1988 Kreitman
4,782,827 A 11/1988 Paratte
4,802,464 A 2/1989 Deprez
4,809,687 A 3/1989 Allen
4,827,496 A 5/1989 Cheney
4,872,656 A 10/1989 Brendgord et al.
4,886,258 A 12/1989 Scott
4,913,413 A 4/1990 Raab
4,940,218 A 7/1990 Akcelrod
5,001,739 A 3/1991 Fischer
5,015,251 A 5/1991 Cherubini
5,025,802 A 6/1991 Laico et al.
5,027,799 A 7/1991 Laico et al.
5,042,508 A 8/1991 Richard
5,052,378 A 10/1991 Chitwood
5,056,535 A 10/1991 Bonnell
5,097,847 A 3/1992 Mikhail et al.
D336,898 S 6/1993 Cherubini et al.
5,290,220 A 3/1994 Guhl
5,369,827 A 12/1994 Parke et al.
5,462,551 A 10/1995 Bailey et al.
5,511,255 A 4/1996 Schuerch
5,514,143 A 5/1996 Bonutti et al.
5,515,562 A 5/1996 Miller et al.
5,542,423 A 8/1996 Bonutti
5,549,707 A 8/1996 Weaver
5,582,379 A 12/1996 Keselman et al.
5,608,934 A 3/1997 Torrie et al.
5,645,079 A 7/1997 Zahiri et al.
5,658,315 A 8/1997 Lamb et al.
5,661,859 A 9/1997 Schaefer
5,799,349 A 9/1998 Petersen
5,802,641 A 9/1998 Van Steenburg
5,806,117 A 9/1998 Gotfried
5,882,280 A 3/1999 Dahlin, Jr.
5,918,330 A 7/1999 Navarro et al.
5,961,085 A 10/1999 Navarro et al.
6,012,456 A 1/2000 Schuerch
6,017,006 A 1/2000 Cherubini et al.
6,058,534 A 5/2000 Navarro et al.
6,263,531 B1 7/2001 Navarro et al.
6,289,537 B1 9/2001 Hopper et al.
6,295,671 B1 10/2001 Reesby et al.
6,295,672 B1 10/2001 Vassallo, Jr.
6,306,146 B1 10/2001 Dinkler
6,378,149 B1 4/2002 Sanders et al.
6,408,464 B1 * 6/2002 Weismiller ..... A61G 13/0009 5/602
6,438,777 B1 8/2002 Bender
6,470,520 B1 * 10/2002 Weismiller ..... A61G 13/0009 5/602
6,491,273 B2 12/2002 King et al.
6,557,195 B2 5/2003 Dinkler
6,698,044 B2 3/2004 Greenfield et al.
6,704,959 B2 3/2004 Schuerch
6,723,036 B2 4/2004 Weaver et al.
6,757,924 B2 * 7/2004 Goodwin ..... A61G 13/0009 5/602
6,804,846 B2 10/2004 Schuerch
6,813,788 B2 11/2004 Dinkler et al.
6,826,794 B2 12/2004 Mahoney et al.
6,869,194 B2 3/2005 Weaver et al.
7,026,940 B2 4/2006 Cherubini
7,073,221 B2 * 7/2006 Goodwin ..... A61G 13/0009 5/602
7,082,631 B2 8/2006 Czop
7,175,900 B2 2/2007 Schaefer
7,210,180 B2 5/2007 Malcolm
7,243,654 B2 7/2007 Schuerch
7,294,114 B1 11/2007 Clement et al.
7,311,441 B2 12/2007 Weaver et al.
7,316,040 B2 1/2008 Siccardi et al.
7,334,276 B2 2/2008 Pfeuffer et al.
7,407,309 B2 8/2008 Scholz
7,412,311 B2 8/2008 Georgi et al.
7,412,739 B2 * 8/2008 Derenne ..... A61G 13/0009 5/602
7,454,806 B2 11/2008 Koch et al.
7,458,117 B2 12/2008 Schaefer
7,464,421 B2 * 12/2008 Goodwin ..... A61G 13/0009 5/602
7,465,065 B2 12/2008 Marka
7,497,006 B2 3/2009 Davis et al.
7,507,244 B2 3/2009 Dinkler
7,513,654 B2 4/2009 Okada
7,517,347 B2 4/2009 Hug et al.
7,520,004 B2 4/2009 Czop
7,520,007 B2 4/2009 Skripps
7,534,270 B2 5/2009 Ball
7,544,007 B2 6/2009 Easton
7,552,492 B2 6/2009 Rolfes et al.
D602,162 S 10/2009 Albrecht et al.
7,600,281 B2 10/2009 Skripps
D604,421 S 11/2009 Albrecht et al.
D604,422 S 11/2009 Albrecht et al.
7,611,460 B2 11/2009 Dobrovolny
7,614,763 B2 11/2009 Leibinger et al.
D606,832 S 12/2009 Wan et al.
7,624,958 B2 12/2009 Ropertz et al.
7,669,258 B2 3/2010 Koch
7,669,261 B2 3/2010 Fruh et al.
7,669,262 B2 3/2010 Skripps et al.
7,730,563 B1 6/2010 Sklar et al.
7,731,141 B2 6/2010 Schuerch
7,739,762 B2 6/2010 Lamb et al.
7,746,009 B2 6/2010 Held et al.
RE41,412 E 7/2010 Van Steenburg
7,757,316 B2 7/2010 Koch
7,784,126 B2 8/2010 Meissner et al.
7,810,185 B2 10/2010 Burstner et al.
7,818,839 B2 10/2010 Koch et al.
7,832,401 B2 11/2010 Torrie et al.
7,836,529 B2 11/2010 Cherubini et al.
7,841,731 B2 11/2010 Marka et al.
7,861,720 B1 1/2011 Wolcott
7,865,985 B2 1/2011 Revenus
7,870,624 B1 1/2011 Winston
D631,970 S 2/2011 Held
7,896,569 B2 3/2011 Katzenstein
7,918,813 B2 4/2011 Drake et al.
7,947,006 B2 5/2011 Torrie et al.
7,999,414 B2 8/2011 Bruhn
8,020,228 B2 9/2011 Rao et al.
8,033,080 B2 10/2011 Revenus
8,051,515 B1 11/2011 Kring
8,070,331 B2 12/2011 Gull et al.
8,118,739 B2 2/2012 Kelly
8,132,278 B1 3/2012 Bailey
8,136,185 B2 3/2012 Olszewski
8,146,963 B2 4/2012 Wyslucha
8,161,586 B2 4/2012 Koch et al.
8,256,047 B2 9/2012 Klemm et al.
8,615,827 B2 12/2013 Newkirk et al.
8,621,692 B1 1/2014 Kring
8,944,065 B2 2/2015 Slusarz, Jr.

(56) References Cited

U.S. PATENT DOCUMENTS

| | | | | |
|---|---|---|---|---|
| 8,997,281 | B2 | 4/2015 | Daley et al. | |
| 8,997,284 | B2 | 4/2015 | Kreuzer et al. | |
| 8,997,286 | B2 | 4/2015 | Wyslucha et al. | |
| 9,730,851 | B2 | 8/2017 | Clark et al. | |
| 2002/0012566 | A1 | 1/2002 | Auchinleck et al. | |
| 2003/0019039 | A1* | 1/2003 | Goodwin | A61G 13/0009 5/602 |
| 2004/0030243 | A1 | 2/2004 | Warschewske et al. | |
| 2004/0226092 | A1* | 11/2004 | Goodwin | A61G 13/0009 5/602 |
| 2005/0043610 | A1 | 2/2005 | Warschewske et al. | |
| 2005/0088763 | A1 | 4/2005 | Weaver et al. | |
| 2006/0117484 | A1* | 6/2006 | Derenne | A61G 13/0009 5/624 |
| 2006/0236457 | A1* | 10/2006 | Goodwin | A61G 13/0009 5/602 |
| 2007/0015960 | A1 | 1/2007 | Gornert et al. | |
| 2007/0107129 | A1 | 5/2007 | Burstner et al. | |
| 2007/0116512 | A1 | 5/2007 | Katzenstein | |
| 2007/0265635 | A1 | 11/2007 | Torrie | |
| 2007/0272808 | A1 | 11/2007 | Schuerch | |
| 2008/0134435 | A1 | 6/2008 | Stolze et al. | |
| 2008/0163427 | A1 | 7/2008 | Howe | |
| 2009/0026901 | A1 | 1/2009 | Nies, III et al. | |
| 2009/0040366 | A1 | 2/2009 | Voelker | |
| 2009/0080190 | A1 | 3/2009 | Bauer et al. | |
| 2009/0085765 | A1 | 4/2009 | Bruhn | |
| 2009/0122536 | A1 | 5/2009 | Scholz | |
| 2009/0126112 | A1 | 5/2009 | Kuchenbecker et al. | |
| 2009/0126115 | A1 | 5/2009 | Doering et al. | |
| 2009/0127433 | A1 | 5/2009 | Rosenheimer et al. | |
| 2009/0141853 | A1 | 6/2009 | Crews | |
| 2009/0201632 | A1 | 8/2009 | Bauer et al. | |
| 2009/0231179 | A1 | 9/2009 | Bruhn | |
| 2009/0231853 | A1 | 9/2009 | Scholz et al. | |
| 2009/0236484 | A1 | 9/2009 | Koch et al. | |
| 2009/0241128 | A1 | 9/2009 | Curbera et al. | |
| 2009/0250073 | A1 | 10/2009 | Alfery et al. | |
| 2009/0316394 | A1 | 12/2009 | Fritze et al. | |
| 2009/0318770 | A1 | 12/2009 | Marka et al. | |
| 2009/0318771 | A1 | 12/2009 | Marka et al. | |
| 2009/0318772 | A1 | 12/2009 | Marka et al. | |
| 2010/0053982 | A1 | 3/2010 | Klaus et al. | |
| 2010/0081887 | A1 | 4/2010 | Marka et al. | |
| 2010/0230567 | A1 | 9/2010 | Schuerch | |
| 2010/0242177 | A1 | 9/2010 | Malcolm et al. | |
| 2010/0242181 | A1 | 9/2010 | Bochner et al. | |
| 2010/0249780 | A1 | 9/2010 | Rolfes | |
| 2010/0263124 | A1 | 10/2010 | Marugg | |
| 2010/0284731 | A1 | 11/2010 | Bauer et al. | |
| 2010/0319713 | A1 | 12/2010 | Byers et al. | |
| 2011/0023893 | A1 | 2/2011 | Striggow et al. | |
| 2011/0190676 | A1 | 8/2011 | Torrie et al. | |
| 2013/0247301 | A1* | 9/2013 | Daley | A61G 13/129 5/613 |
| 2014/0068864 | A1 | 3/2014 | Clark et al. | |
| 2017/0319415 | A1* | 11/2017 | Clark | A61G 13/101 |

OTHER PUBLICATIONS

European Search Report for EP 17 15 1791 dated Feb. 21, 2017, 11 pages.

* cited by examiner

SURGICAL SUPPORT SYSTEM

This application is a continuation of U.S. application Ser. No. 13/799,251, filed Mar. 13, 2013, now U.S. Pat. No. 9,730,851, which claims the benefit of U.S. Provisional Application No. 61/698,547, filed on Sep. 7, 2012, each of which is hereby incorporated by reference herein.

BACKGROUND OF THE DISCLOSURE

This disclosure relates to surgical support systems. More particularly, but not exclusively, one contemplated embodiment relates to a connector assembly configured to attach a table extensions and/or a leg support to a surgical table. While various connector assemblies have been developed, there is still room for improvement. Thus, a need persists for further contributions in this area of technology.

SUMMARY OF THE DISCLOSURE

In one contemplated embodiment, a surgical support system comprises a surgical table; a first leg support assembly coupled to the surgical table; a second leg support assembly; and a surgical table extension coupled to the surgical table and including a first connector and a second connector and a connector enabling assembly configured to selectively enable the second leg support assembly to be coupled to one of the first connector and the second connector.

In another contemplated embodiment, a surgical support system comprises a surgical table; a leg support assembly including a leg support connector with a hook shaped portion; and a surgical table extension coupled to the surgical table and including a first connector defining a first slot with a first shaft extending across the first slot and a second connector defining a second slot with a second shaft extending across the second slot, wherein the hook shaped portion is configured to engage one of the first shaft and the second shaft when the leg support connector is inserted into one of the first slot and the second slot, respectively.

In another contemplated embodiment, a bracket for coupling at least one surgical table accessory to a surgical table comprises a rail coupling portion; a first accessory retaining portion; and a second accessory retaining portion positioned vertically below the first retaining portion.

In another contemplated embodiment a surgical table extension comprises a surgical table frame coupled to a surgical table by a connecting assembly; a first accessory connector; a second accessory connector; and an accessory connector enabling assembly configured to be moved between a first position and a second position, wherein the first accessory connector is configured to receive and retain an accessory when the accessory connector enabling assembly is in the first position and the second accessory connector is configured to receive and retain an accessory when the accessory connector enabling assembly is in the second position. Additional features, which alone or in combination with any other feature(s), such as those listed above and/or those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
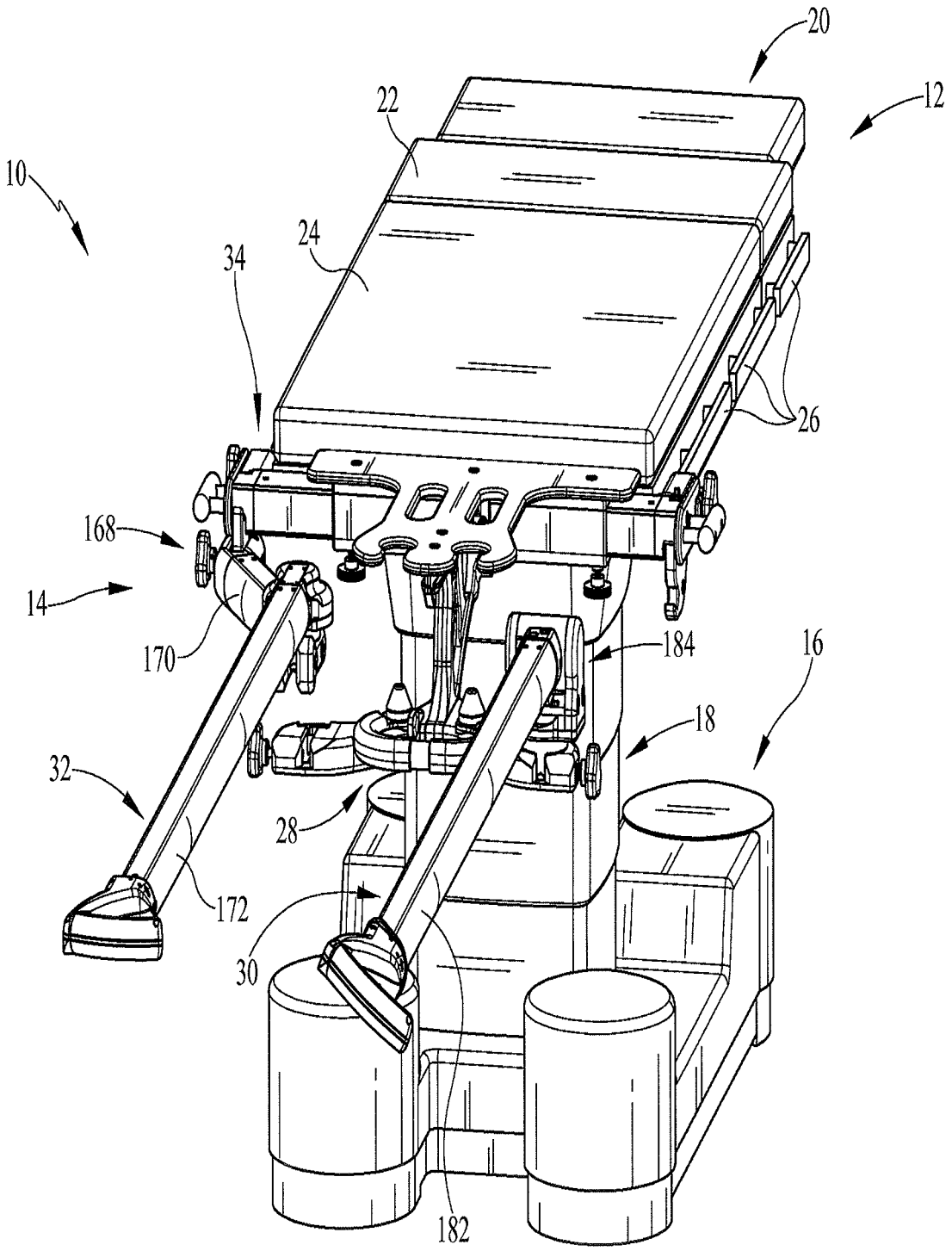
FIG. 1 is a perspective side view of a surgical support system according to one illustrative embodiment of the current disclosure showing a surgical table and a hip distractor assembly.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

A surgical support system 10 according to one contemplated embodiment is shown in FIGS. 1-16. The system 10 includes a surgical person support apparatus 12 and a hip distractor assembly 14 or surgical support device 14 coupled to the person support apparatus 12. In one contemplated embodiment, the person support apparatus 12 is a surgical table 12 or operating room table 12 and includes a base 16, a lift system 18, and an upper frame 20 movably supported above the base. The upper frame 20 includes a head section 22, a seat section 24 and attachment rails 26. In some contemplated embodiments the upper frame 20 includes a foot section (not shown) that can be removed or moved out of the way when surgical equipment or accessories, such as, the hip distractor assembly 14 or a surgical spine system like the Allen® Spine System sold by Allen Medical Systems, are attached to the surgical table 12 as shown in FIG. 1. The rails 26 extend along the sides of the sections 22 and 24 and are configured to provide a connection point where accessories and equipment can be attached to the surgical table 12.

Figure 3:
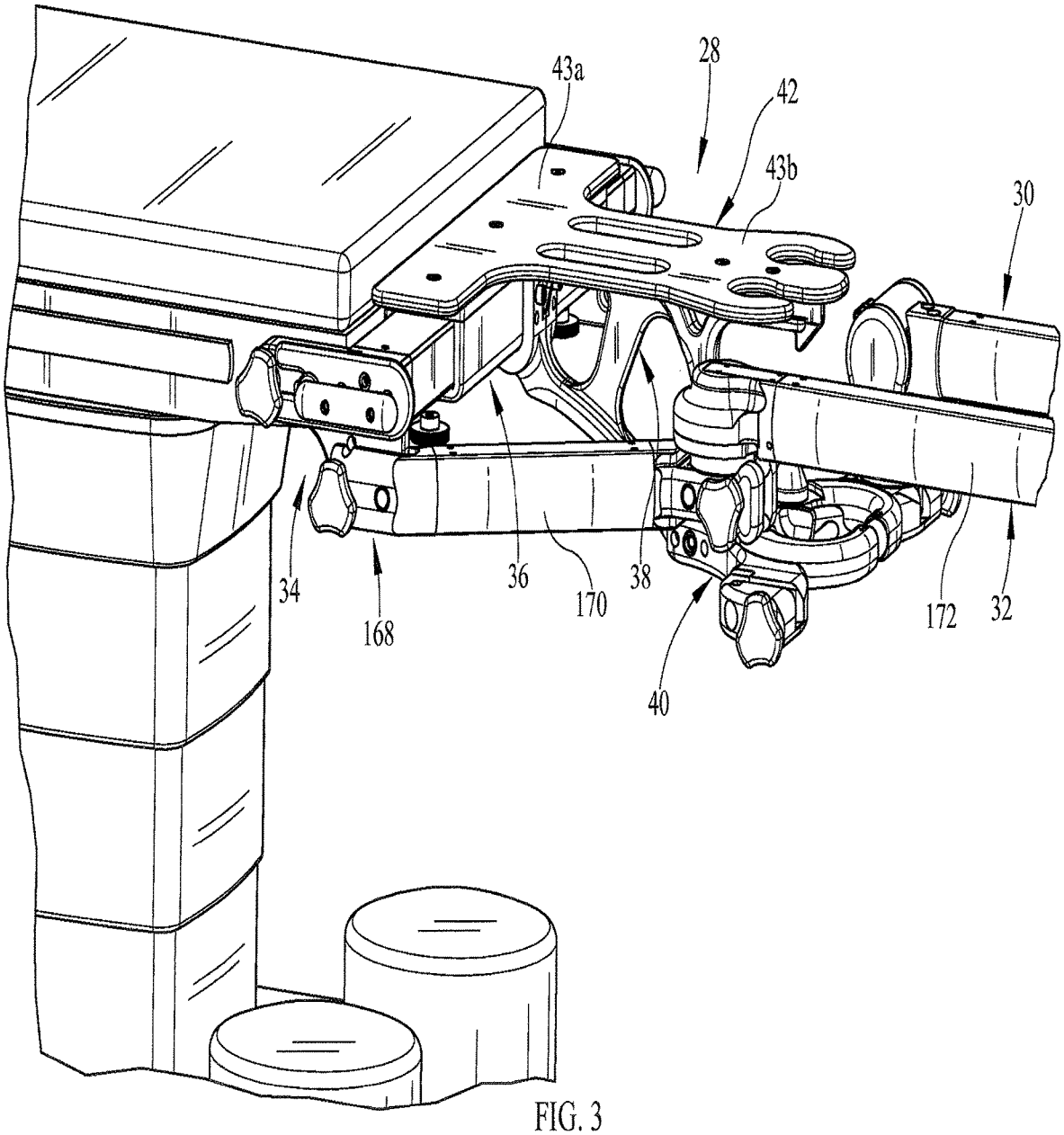
FIG. 3 is a perspective side view of the hip distractor assembly of FIG. 1 showing the table extension and non-operative leg holder assembly coupled to the surgical table by the same bracket.
Figure 4:
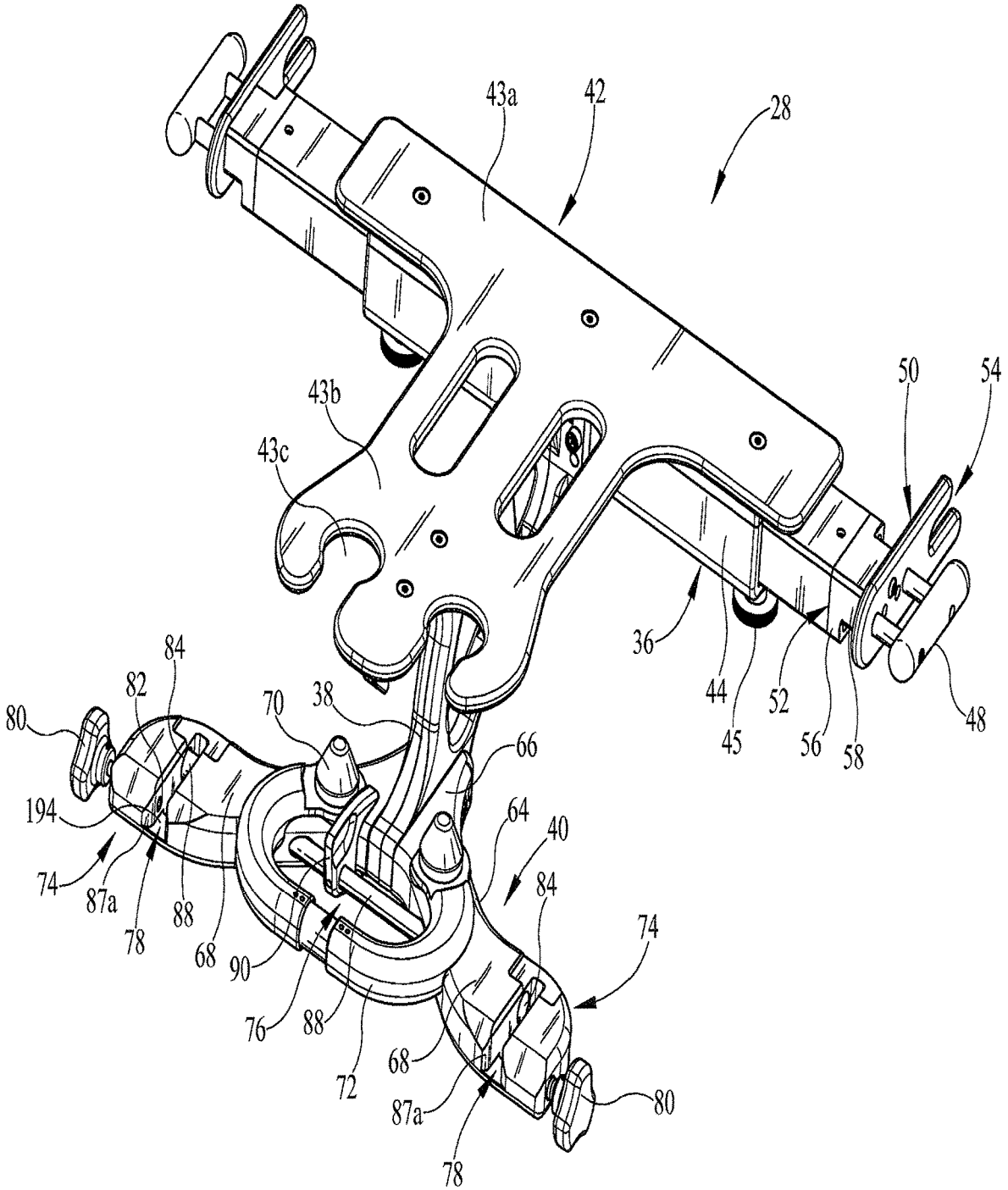
FIG. 4 is a perspective top view of the table extension of FIG. 1.
Figure 5:
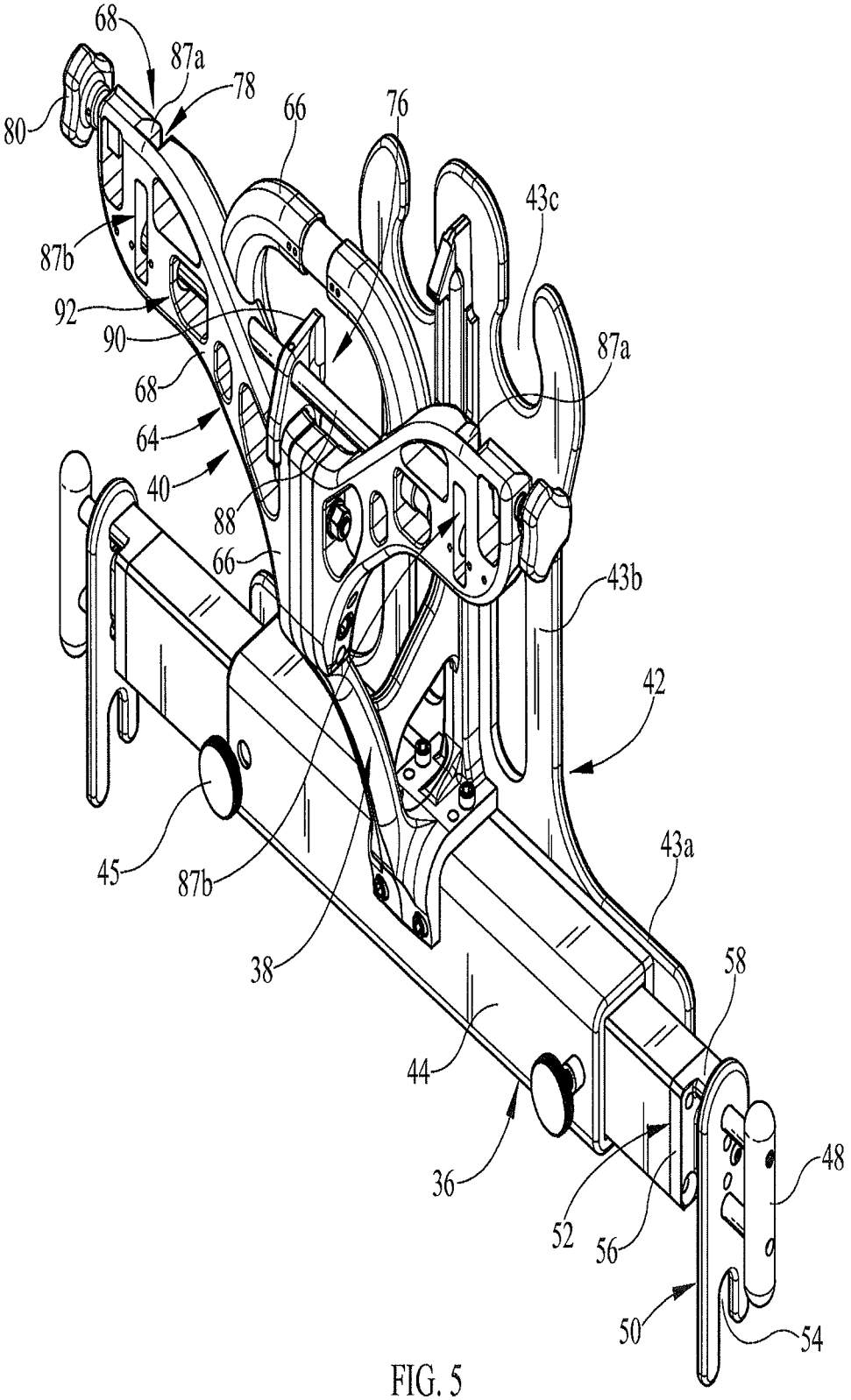
FIG. 5 is a perspective bottom view of the table extension of FIG. 1.
Figure 6:
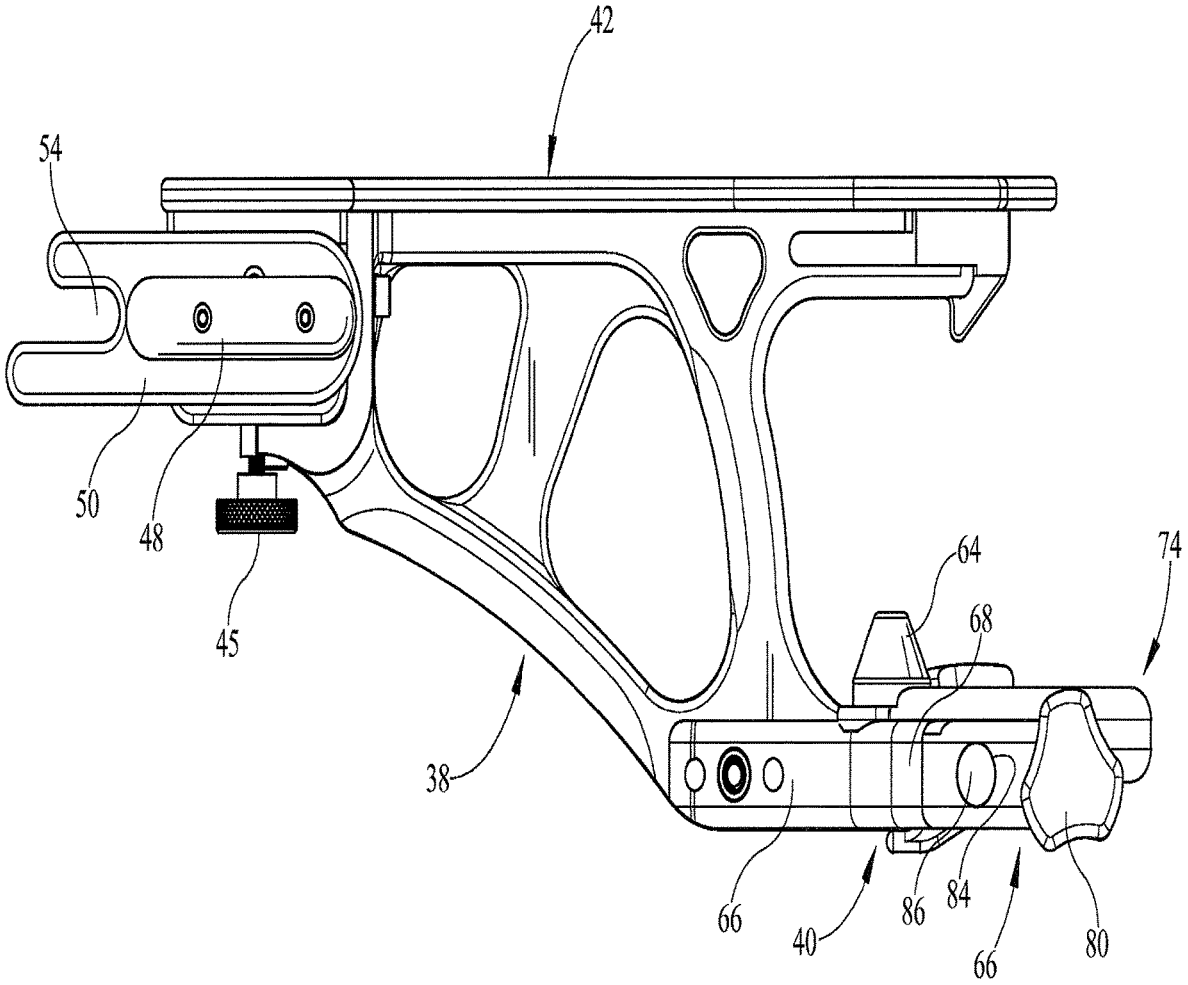
FIG. 6 is a side view of the table extension of FIG. 1.
Figure 7:
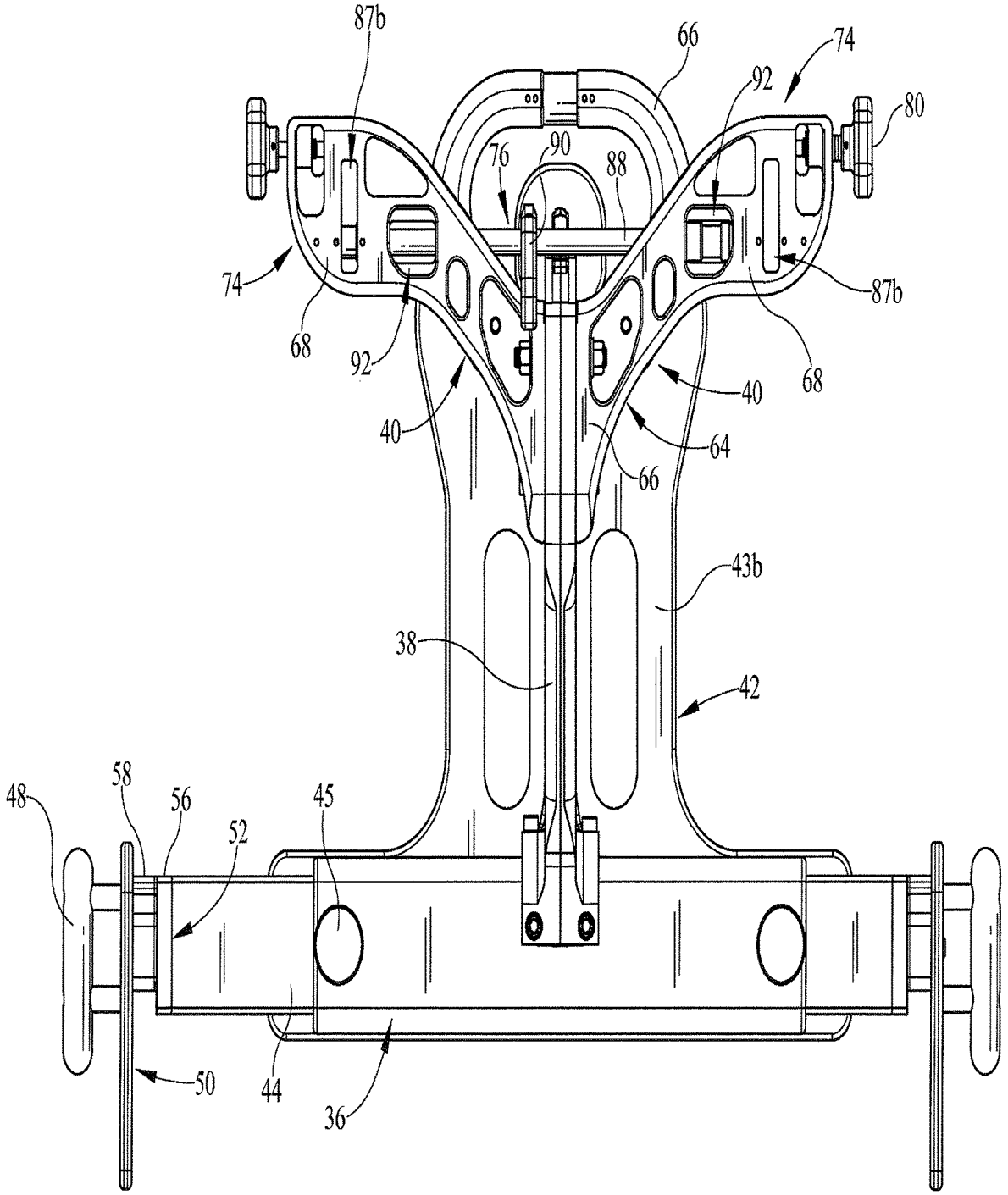
FIG. 7 is a bottom view of the table extension of FIG. 1.

The hip distractor assembly 14 includes a table extension 28, an operative leg holder assembly 30 or leg support 30, a non-operative leg holder assembly 32 or leg support 32, and mounting brackets 34 or connector 34 as shown in FIG. 3. The table extension 28 and the non-operative leg holder assembly 32 are configured to be coupled to the rails 26 via the brackets 34, and the operative leg holder assembly 30 is configured to be coupled to the table extension 28.

Figure 2:
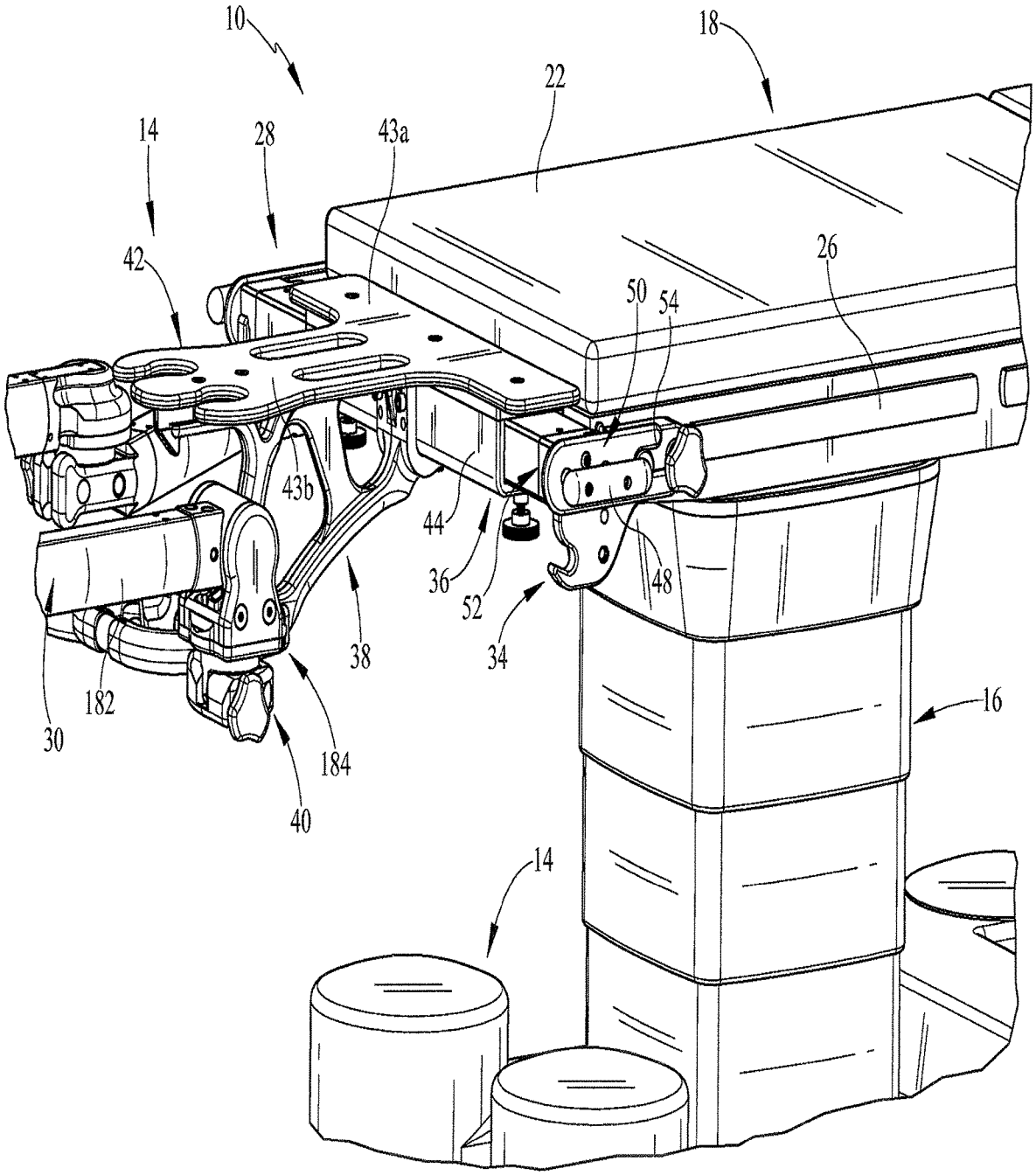
FIG. 2 is a perspective side view of the hip distractor assembly of FIG. 1 showing the table extension coupled to the surgical table by a bracket.

The table extension 28 comprises a table coupling assembly 36, a connecting frame 38, a Y-shaped support frame assembly 40, and a platform 42 as shown in FIGS. 1-3. The connecting frame 38 is coupled between the table coupling assembly 36 and the support frame assembly 40 and includes an upper portion that cooperates with the table coupling assembly 36 to support the platform 42, and a lower portion that supports the support frame assembly 40 vertically below a portion of the platform 42. The platform 42 is substantially planar and includes a base portion 43*a* coupled to the table coupling assembly 36, and a hip support portion 43*b* extending from the base portion 43*a* that is coupled to the connecting frame 38. In some contemplated embodiments, a support surface (not shown), such as, a foam pad, can be positioned on the platform 42. The hip support portion 43*b* is shaped to support a person's non-operative hip while allowing the person's operative hip to hang off the platform 42 unsupported.

The table coupling assembly 36 includes a length adjustable beam 44 and coupling assemblies (described below) attached to the ends of the beam 44 as shown in FIGS. 4-8. The length adjusting beam 44 includes a telescoping arrangement that is configured to be adjusted to match the width of the person support apparatus 12, and locked in place with locking screw 45 when a desired width has been reached. The coupling assemblies include a handle 48, a fork plate 50, and an insert 52. The handle 48 is coupled to the fork plate 50 and the fork plate 50 is coupled to the beam 44 by the insert 52. The fork plate 50 includes a guide slot 54 that is configured to engage the bracket 34 to help position the table extension 28 and maintain the engagement of the table extension 28 and the bracket 34. The fork plate 50 is shorter in length along the upper portion of the guide slot 54 to provide a lead in section that make it easier for a user to engage the bracket 34 with the guide slot 54. The insert 52 includes a base portion 56 and an extension 58 that extends from the base portion 56. The extension 58 includes a groove 60 and a curved portion 62 that are configured to engage the bracket 34 to help position the table extension 28 and maintain the engagement of the table extension 28 and the bracket 34.

The support frame assembly 40 is generally Y-shaped and is configured to support the operative leg holder assembly 30. The support frame assembly 40 includes a frame 64 with a base 66 and angled arms 68, perineal post cones 70, a handle 72, connecting portion 74, and a mounting assembly 76 or connector enabling assembly 76 as shown in FIGS. 4-7. In some contemplated embodiments, the support frame 40 supports a perineal post (not shown) that extends up through the opening 43*c* in the platform 42 on a perineal post cone 70. The base 66 is coupled to the connecting frame 38 and the angled arms 68 extend from the base 66 to form Y shape. The handle 72 is coupled between the angled arms 68 and is configured to be used to transport the table extension 28. The perineal post cones 70 are coupled to the angled arms 68 and are aligned with the openings 43*c* in the panel 42. The connecting portions 74 are located at the ends of the angled arms 68 and include an elongated slot 78 formed in the angled arm 68, a locking knob 80 positioned in a locking bore 82, and a mounting bore 84 that a portion of the mounting assembly 76 moves within. In some contemplated embodiments a plug 86 can be inserted into an end of the mounting bore 84. The elongated slot 78 includes rounded opening edges 87*a* that helps guide the leg holder assembly into the slot 78, and an opening 87*b* in the bottom of the slot to help position and maintain the leg holder assembly in the slot 78.

The mounting assembly 76 extends between the angled arms 68 and is configured to allow a user to select which connecting portion 74 they would like to attach the operative leg holder assembly 30 to. The mounting assembly 76 includes a shaft 88 and a handle 90 coupled to the shaft 88 as shown in FIGS. 4-7. The shaft 88 is sized such that the shaft 88 can only extend across the slot 78 of one of the connecting portions 74 so that only one operative leg holder assembly 30 can be supported by the table extension 28 at a time. The handle 90 is configured to move the shaft 88 and allow a user to select the connecting portion 74 they would like to attach the operative leg holder assembly 30 to. The shaft 88 is positioned within the mounting bores 84 and extends between the slots 78. In some contemplated embodiments, the shaft 88 is sized so that the shaft 88 does not extend across the slot of either connecting portion 74 when the handle 90 is in a neutral position. In some contemplated embodiments, the shaft 88 is sized to extend across both slots 78 simultaneously, or two smaller shafts (not shown) are used and are positioned such that they each extend across one of the slots 78 so that more than one leg holder assembly can be supported by the table extension 28. In some contemplated embodiments, an indicator or a graphic (not shown) is used to indicate which way to move the handle 90 based on the patient's legs to be supported. In some contemplated embodiments, the indicator or graphic is used to indicate which leg should be supported based on the current configuration of the device (i.e., left, right, none). In another contemplated embodiment, the angled arms 68 include a pair of go/no-go openings 92 that show a portion of the mounting shaft 88 that may be colored red or green to indicate which connecting portion 74 the user can connect a leg holder assembly to.

The coupling bracket 34 includes a first side S1, a second side S2, a third side S3 extending between the first side S1 and the second side S2, a rail adapter portion 136, a guide pin 138, a locking knob 140, a table extension support 142, and a leg holder support portion 144 as shown in FIGS. 8-12. The rail adapter portion 136 extends from the first side S1 and is configured to engage the rail 26 and movably retain the bracket 34 on the rail 26. The rail adapter portion 136 includes an upper guide 146 that engages a portion of a top edge of the rail 26 and a lower guide 148 that engages a portion of the bottom edge of the rail 26. The guide 138 extends from the second side S2 and is configured to be engaged by table extension 28 and help align and support the table extension 28 when the table extension 26 is coupled to the bracket 34.

The locking knob 140 extends from the second side S2 that is adjacent to the guide pin 138 and positioned in a locking opening 145 extending though the bracket 34 as shown in FIGS. 8-12. The locking knob 140 is configured to cooperate with the guide 146 and lower guide 148 to selectively engage the rail 26 to prevent the bracket 34 from moving with respect to the rail 26. In some contemplated embodiments the locking knob 140 is captured in the bracket 34 so that the locking knob 140 is prevented from falling off when the knob 140 is loosened to allow the bracket 34 to be removed from the rail 26.

Figure 8:
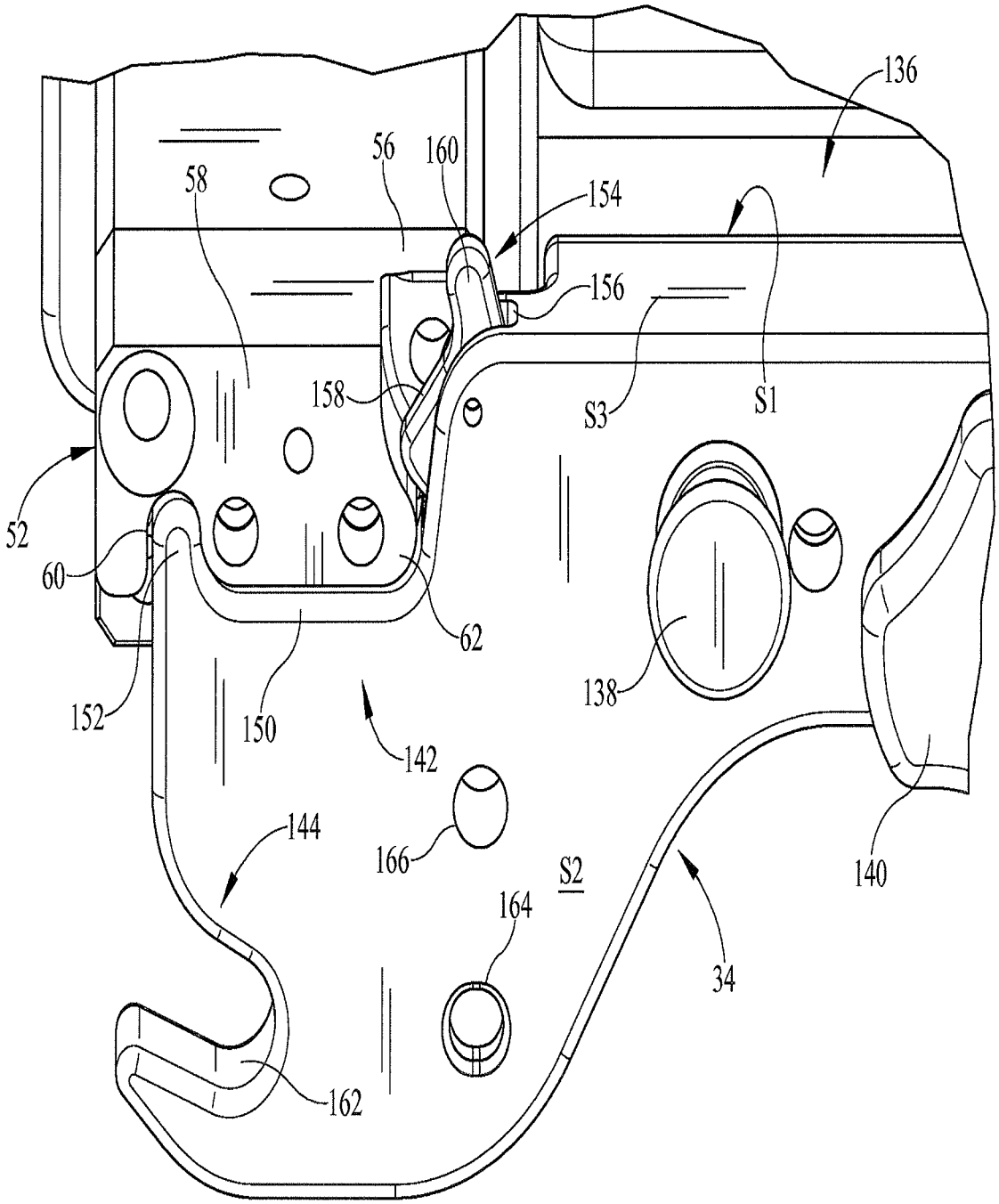
FIG. 8 is a perspective side view of the bracket of FIG. 2 showing the insert engaging the bracket.
Figure 9:
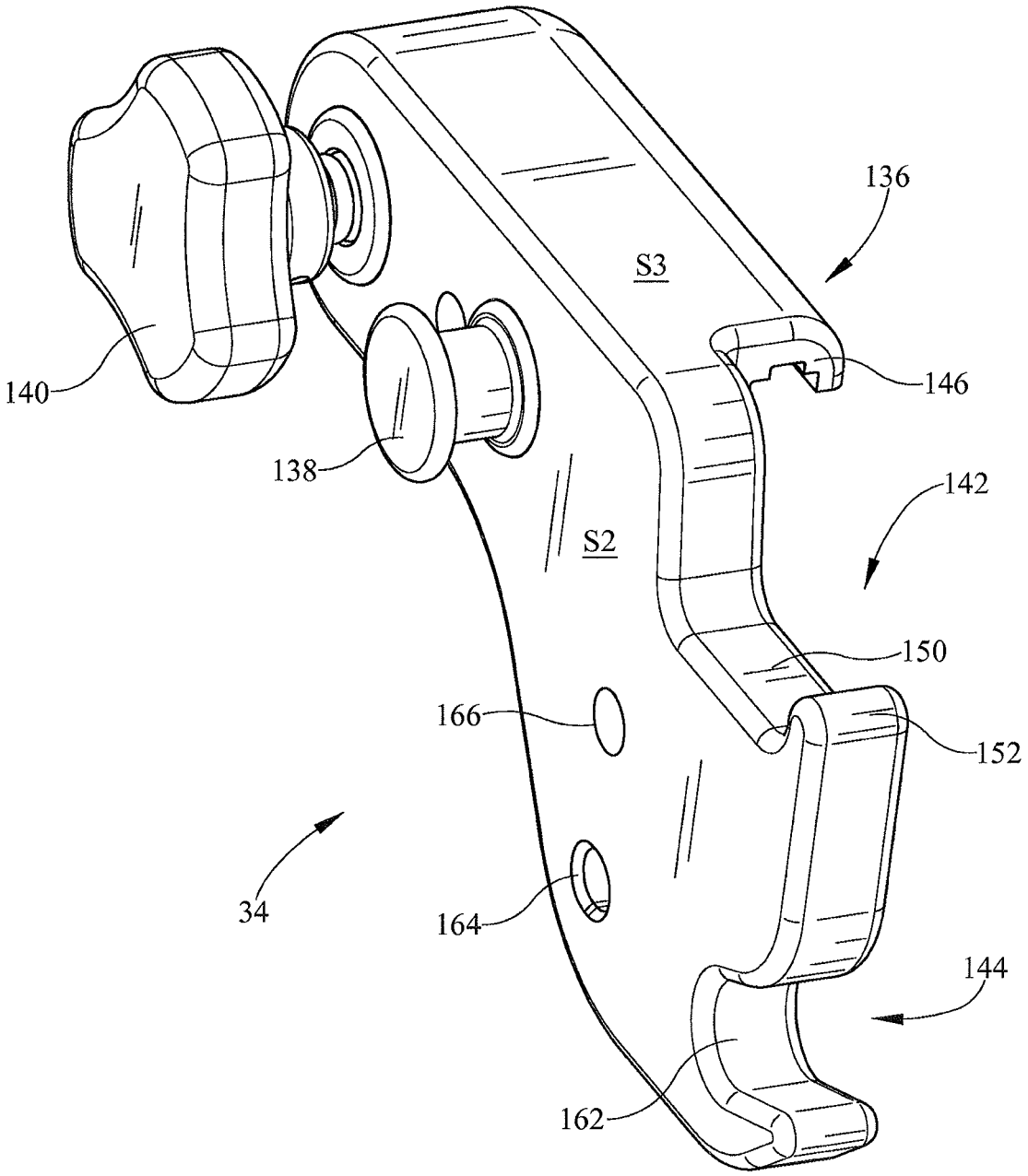
FIG. 9 is a perspective top view of the bracket of FIG. 2.
Figure 10:
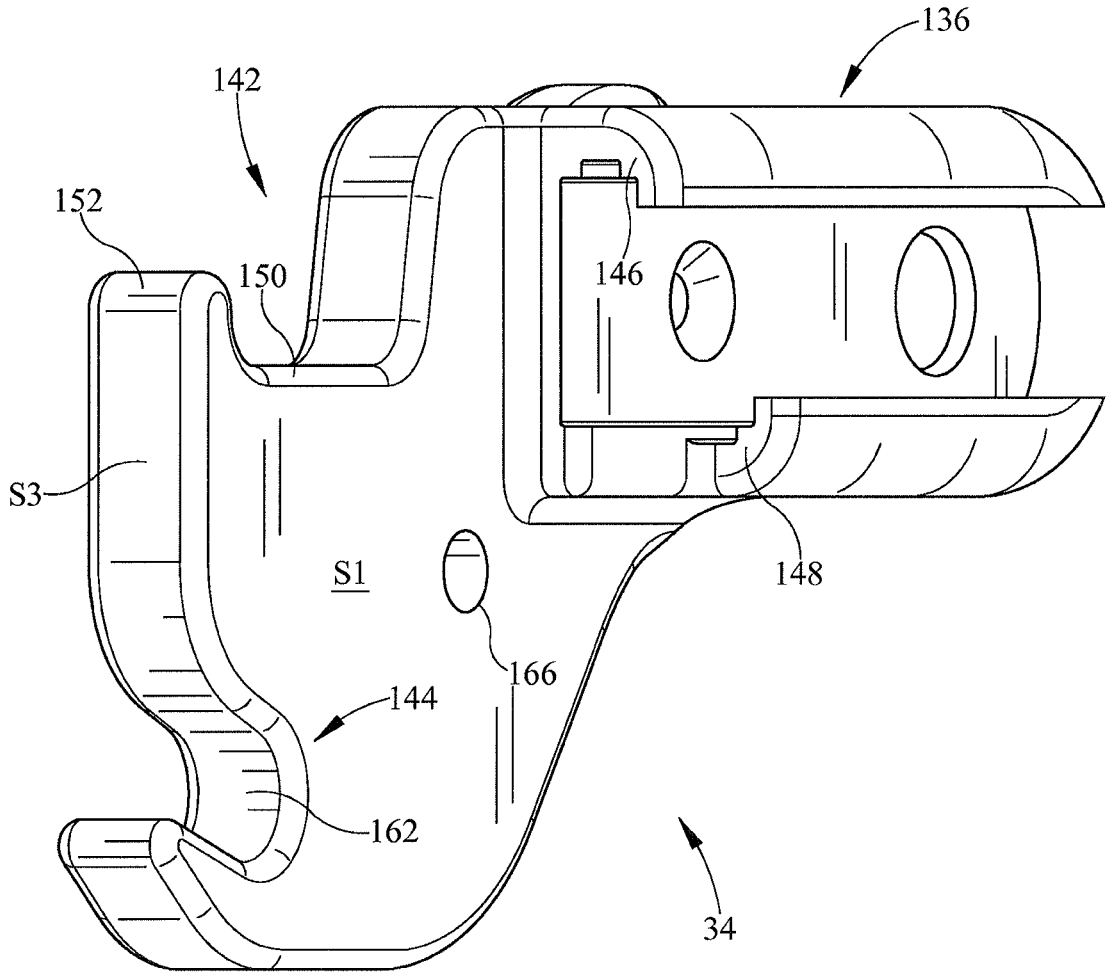
FIG. 10 is a perspective side view of the bracket of FIG. 2 showing the rail adapter portion.
Figure 11:
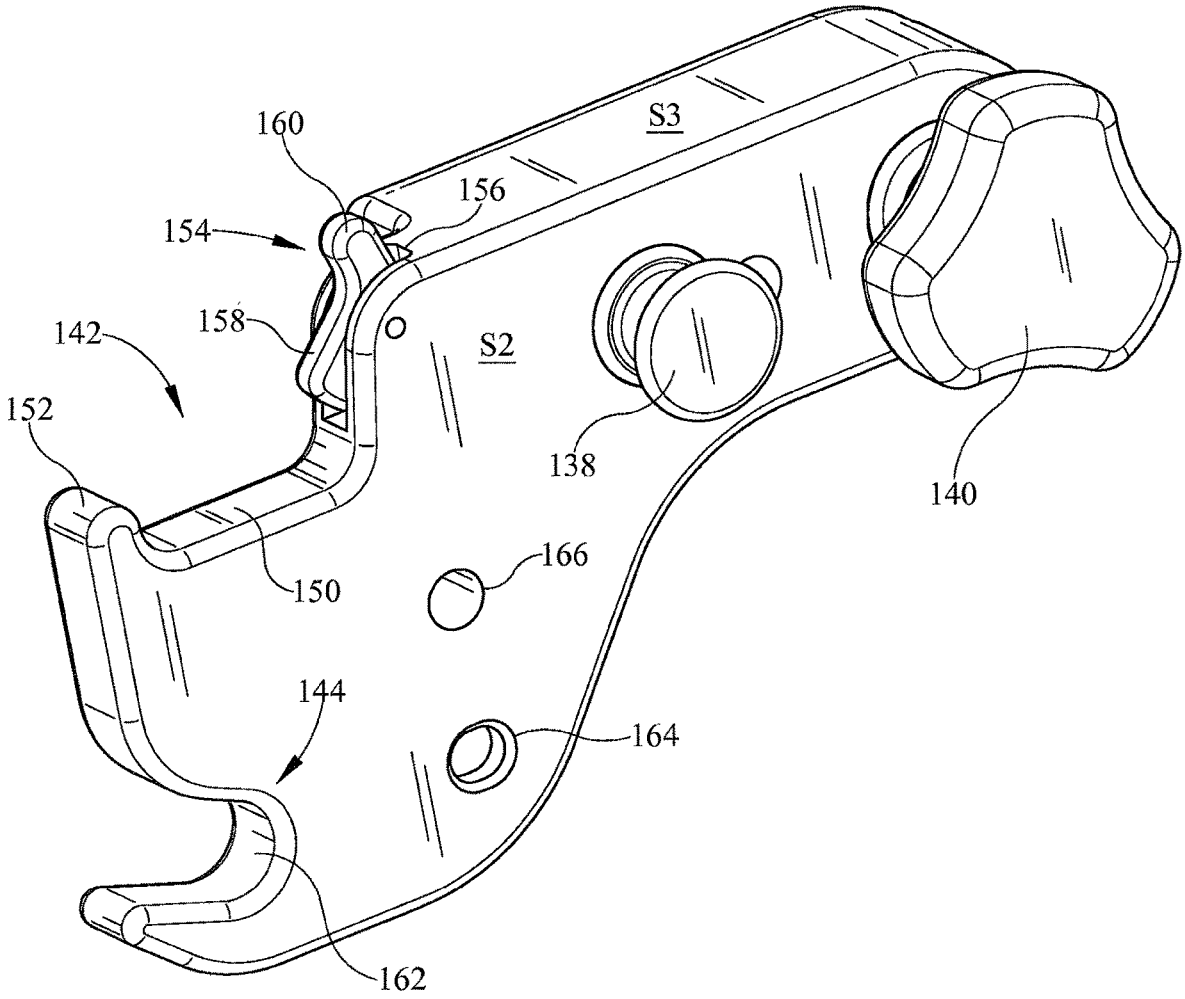
FIG. 11 is a perspective side view of the bracket of FIG. 3 showing the trigger.
Figure 12:
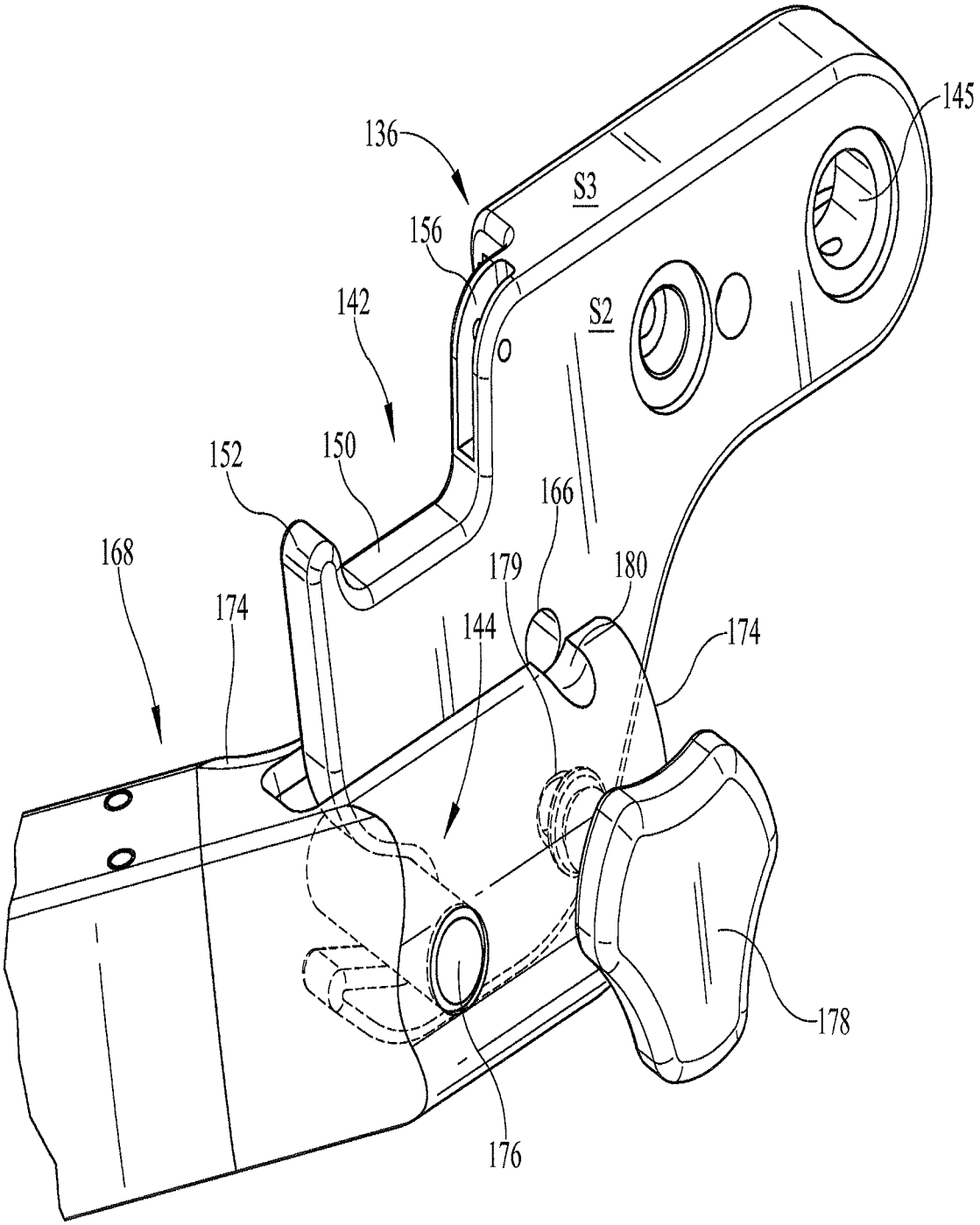
FIG. 12 is a perspective side view of the non-operative leg holder of FIG. 1 showing the coupling portion coupled to the bracket.
Figure 13:
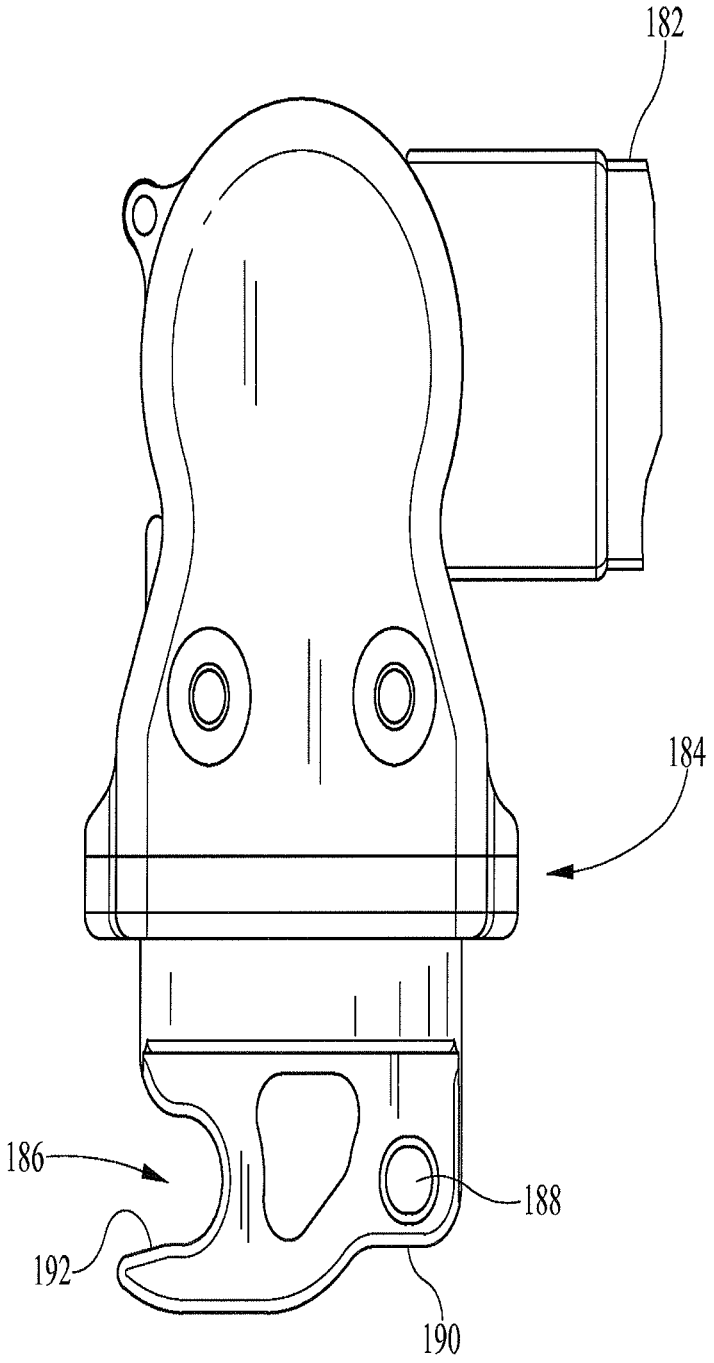
FIG. 13 is a side view of the connector for the operational leg holder assembly of FIG. 1 showing the connector.
Figure 14:
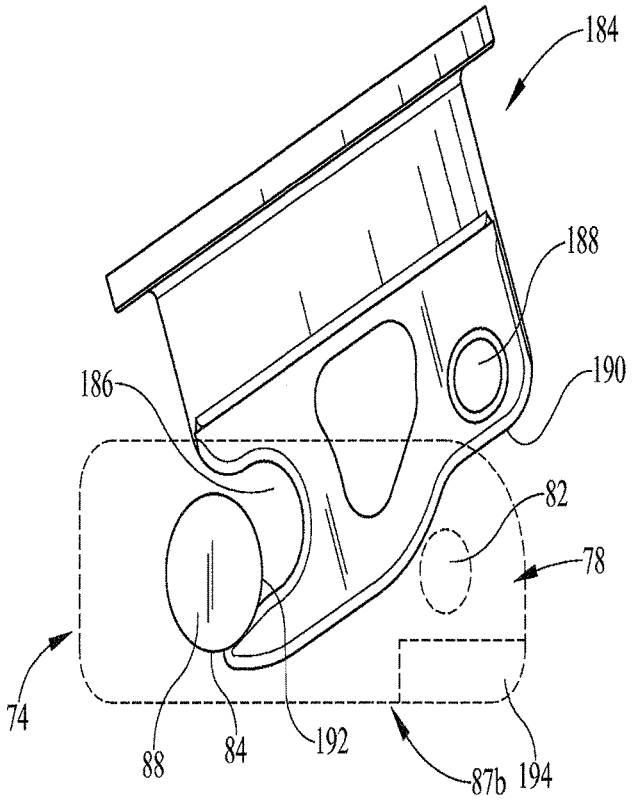
FIG. 14 is a side view of the connector of FIG. 13 being inserted in the slot on the table extension.

The table extension support 142 includes an insert engaging surface 150 with a protrusion 152 and a trigger 154. The insert engaging surface 150 is configured to be engaged by the extension 58 and the protrusion 152 is configured to engage the slot 60 in the insert 52 as shown in FIG. 8. The trigger 154 is configured to selectively engage the curved portion 62 of the extension 58 to maintain the insert 52 from being removed from the table extension support 142 as shown in FIGS. 8 and 12. In some contemplated embodiments, the trigger 154 is only included on one of the brackets 34 coupling the table extension 28 to the surgical table 12. The trigger 154 is rotatably coupled within a trigger recess 156 that is recessed from the third surface S3 and includes an angled surface 158 and a stop arm 160. When the table extension 28 is being coupled to the bracket 34 and the extension 58 is moved into engagement with the insert engaging surface 150, the curved portion 62 of the insert 54 engages an angled side 158 of the trigger 154 and causes the trigger 154 to rotate from a first position, where the stop arm 160 engages the back of the trigger recess 156, to a second position, where the stop arm 160 is away from the back of the trigger recess 156. When the extension 58 engages the insert engaging surface 150, gravity (or a spring mechanism) causes the trigger 154 to rotate back to the first position to prevent the table extension 28 from accidentally or unintentionally being removed from the bracket 34. The trigger 154 must be manually moved from the first position to the second position by a user before the table extension 28 can be removed from the bracket 34. To do so, a user can use their thumb to pull the stop arm 160 away from the back of the trigger recess 156 and remove the insert 54 from the table extension support 142.

The leg holder support portion 144 includes a hook shaped recess 162, a locking knob opening 164, and an anti-rotation pin opening 166 as shown in FIGS. 8-12. The hook shaped recess 162 is positioned generally vertically below the table extension support portion 142 and is shaped to help guide the coupling pin 176 of the non-operative leg coupling assembly 168 toward the base of the hook shaped recess 162. The anti-rotation pin opening 166 is configured to receive an anti-rotation pin (not shown) that engages the recessed groove 180 in the coupling assembly 168 and prevents the leg holder assembly 32 from rotating when the coupling pin 60 is located at the base of the hook shaped recess 54. By preventing rotation of the non-operative leg holder assembly 32, a user can attach the leg holder assembly 32 to the bracket 34 and secure the leg holder assembly 32 with the leg holder locking knob 178 without having to support the leg holder assembly 32 themselves to maintain alignment of the locking knob opening 164 and the leg holder locking knob 178.

The non-operative leg holder assembly 32 includes a non-operative leg coupling assembly 168, a first spar 170 or adapter 170, and a second spar 172 as shown in FIGS. 1-3 and 12. The coupling assembly 168 is generally U-shaped bracket 174 with the coupling pin 176 extending between the sides of the bracket 174, and the leg holder locking knob 178 engaging a locking opening 179 passing through one side of the bracket 174. In some contemplated embodiments, the bracket 174 includes a recessed groove 180 configured to engage the anti-rotation pin extending from the bracket 34. The coupling assembly 168 is attached to the first spar 170 and the first spar 170 is rotatably attached to the second spar 172. The second spar 172 is configured to support a foot holding device (not shown). In one contemplated embodiment, the first spar 170 is pivotably and removably coupled to the second spar 172 at a joint. In another contemplated embodiment, the user couples the first spar 170 to the second spar 172 in a first orientation when the assembly 32 is connected to one side of the person support apparatus 12, i.e., the left side, and disconnects, flips over, and reconnects the first spar 170 to the second spar 172 in a second orientation when the user desires to connect the assembly 32 to the other side, i.e., the right side, of the person support apparatus 12.

Figure 15:
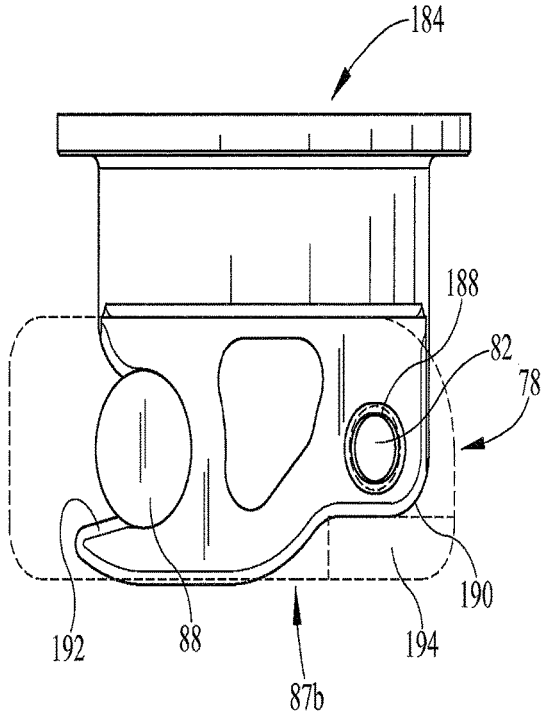
FIG. 15 is a side view of the connector of FIG. 13 secured in the slot.
Figure 16:
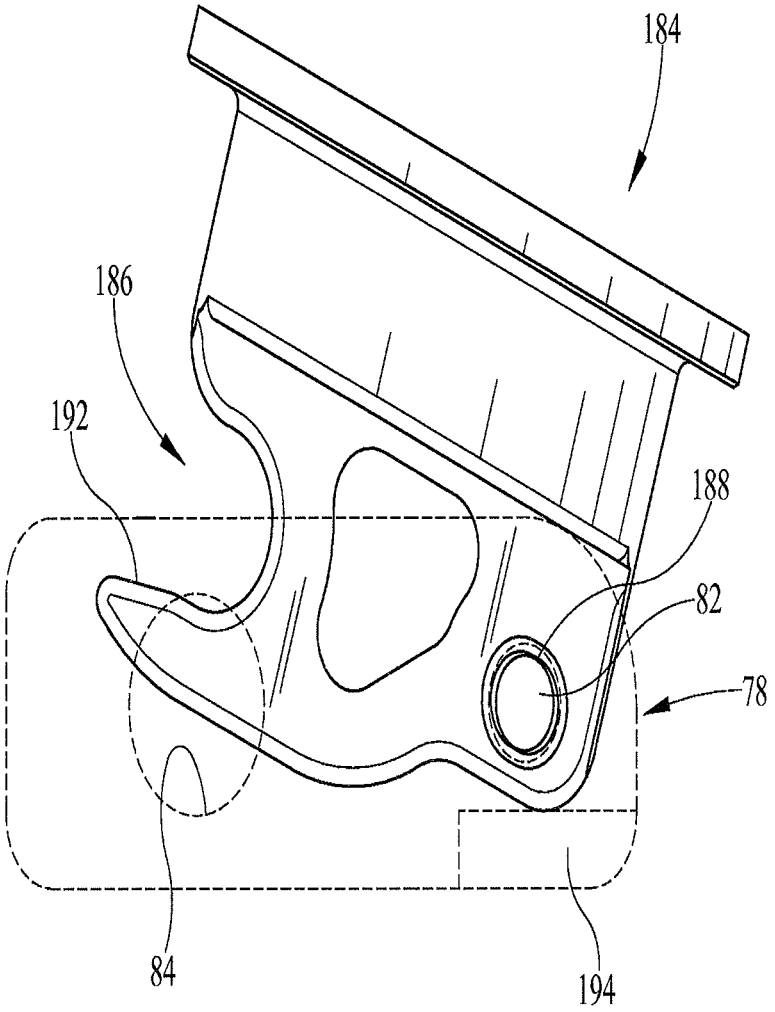
FIG. 16 is a side view of the connector of FIG. 13 not secured in the slot.

The operative leg holder assembly 30 includes a spar 182 and a connector 184 coupled to the end of the spar 182 as shown in FIGS. 1-2 and 13-16. The connector 184 includes a hook end 186, a locking bore 188, and a mounting end 190 opposite the hook end 186. The hook end 186 is configured to engage the mounting shaft 88 when the operative leg holder assembly 30 is attached to the connecting portion 74 of the table extension 28. The hook end 186 includes an angled end 192 that helps guide the mounting shaft 88 toward the base of the hook 186. The connector 184 is shaped such that when the hook end 186 engages the mounting shaft 88, a portion of the connector 184 extends through the opening 87*b* in the bottom of the slot 78 and the mounting end 190 engages the mounting portion 194 of the slot 78 to help position the connector 184 in the slot 78 such that the locking bore 188 and the locking bore 82 are substantially aligned so the locking knob 80 can be tightened to secure the leg holder assembly 30 to the table extension 28 as shown in FIG. 15. In addition to help position the connector 184 in the slot 78, the mounting end 190 helps maintain the engagement of the hook end 186 and the mounting shaft 88 so that the leg holder assembly 30 is supported by the table extension 28 and the user does not need to support the leg holder assembly 30 while attempting to secure it in place with the locking knob 80. If a user attempted to mount the leg holder assembly 30 to a connecting portion 74 that the mounting shaft 88 did not extend across, the leg holder assembly 30 would not be fully supported by the table extension 28 because the connector 184 would be allowed to rotate in the slot 78 as shown in FIG. 16, due to the rotational moment caused by the weight of the leg holder assembly 30.

Many other embodiments of the present disclosure are also envisioned. For example, a surgical support system comprises a surgical table; a first leg support assembly coupled to the surgical table; a second leg support assembly; and a surgical table extension coupled to the surgical table and including a first connector and a second connector and a connector enabling assembly configured to selectively enable the second leg support assembly to be coupled to one of the first connector and the second connector.

In another example, a surgical support system comprises a surgical table; a leg support assembly including a leg support connector with a hook shaped portion; and a surgical table extension coupled to the surgical table and including a first connector defining a first slot with a first shaft extending across the first slot and a second connector defining a second slot with a second shaft extending across the second slot, wherein the hook shaped portion is configured to engage one of the first shaft and the second shaft when the leg support connector is inserted into one of the first slot and the second slot, respectively.

In another example, a bracket for coupling at least one surgical table accessory to a surgical table comprises a rail coupling portion; a first accessory retaining portion; and a second accessory retaining portion positioned vertically below the first retaining portion.

In another example a surgical table extension comprises a surgical table frame coupled to a surgical table by a connecting assembly; a first accessory connector; a second accessory connector; and an accessory connector enabling assembly configured to be moved between a first position and a second position, wherein the first accessory connector is configured to receive and retain an accessory when the accessory connector enabling assembly is in the first position and the second accessory connector is configured to receive and retain an accessory when the accessory connector enabling assembly is in the second position.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described may be more desirable, it nonetheless may not be necessary and embodiments lacking the same may be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item may include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations may be apparent to those skilled in the art. Also, while multiple inventive aspects and principles may have been presented, they need not be utilized in combination, and various combinations of inventive aspects and principles are possible in light of the various embodiments provided above.

The invention claimed is:

1. A surgical table extension comprising:

a frame including a surgical table connecting portion, the frame including a frame member having a first connector space and a second connector space; and a connector movably coupled to the frame for movement between first and second positions, the connector having a first region exposed in the first connector space when the connector is in the first position, the connector having a second region exposed in the second connector space when the connector is in the second position, the second region being inaccessible when the connector is in the first position, the first region being inaccessible when the connector is in the second position, and the first and second regions of the connector being configured to be removably coupled with a support device when exposed in the first and second connector spaces, respectively.

2. The surgical table extension of claim 1, wherein the support device is configured to support a person's limb.

3. The surgical table extension of claim 1, wherein the connector has a third position in which both of the first region and the second region are inaccessible.

4. The surgical table extension of claim 1, wherein the first connector space includes a first slot, the second connector space includes a second slot, the frame includes a bore extending between the first slot and the second slot, and the connector includes a shaft positioned within the bore.

5. The surgical table extension of claim 1, further comprising an indicator on the connector.

6. The surgical table extension of claim 5, wherein the frame includes a bore extending between the first connector space and the second connector space, and the connector includes a shaft positioned within the bore, a portion of the shaft being colored to serve as the indicator.

7. The surgical table extension of claim 1, further comprising an indicator on each of the first and second regions.

8. The surgical table extension of claim 1, wherein the frame includes a mounting portion configured to support weight of the support device when a connecting portion of the support device engages the connector.

9. The surgical table extension of claim 8, wherein the frame includes a securing element configured to secure the support device when the connecting portion of the support device engages the connector.

10. The surgical table extension of claim 8, wherein the mounting portion and the connector cooperate to prevent the support device from detaching from the frame.

11. The surgical table extension of claim 10, wherein the connecting portion includes a mount engaging portion configured to engage the mounting portion and a hook configured to engage the connector.

* * * * *